US008982527B2

(12) United States Patent
De Haas et al.

(10) Patent No.: US 8,982,527 B2
(45) Date of Patent: Mar. 17, 2015

(54) SYSTEM AND METHOD FOR DRIVING A RELAY CIRCUIT

(75) Inventors: Clemens Gerhardus Johannes De Haas, Ewijk (NL); Luc Van Dijk, Kranenburg (DE)

(73) Assignee: NXP B.V., Eindhoven (NL)

( * ) Notice: Subject to any disclaimer, the term of this patent is extended or adjusted under 35 U.S.C. 154(b) by 909 days.

(21) Appl. No.: 12/892,745

(22) Filed: Sep. 28, 2010

(65) Prior Publication Data

US 2012/0075765 A1 Mar. 29, 2012

(51) Int. Cl.
*H01H 47/32* (2006.01)
*H01H 47/00* (2006.01)
*F02N 11/08* (2006.01)

(52) U.S. Cl.
CPC ..... *H01H 47/32* (2013.01); *H01H 47/002* (2013.01); *H01H 47/001* (2013.01); *F02N 11/087* (2013.01); *F02N 2200/063* (2013.01)
USPC ..... 361/169.1; 361/168.1

(58) Field of Classification Search
CPC .... H01H 47/32; H01H 47/001; H01H 47/002
USPC ..... 361/205
See application file for complete search history.

(56) References Cited

U.S. PATENT DOCUMENTS

| | | | | |
|---|---|---|---|---|
| 4,214,290 | A * | 7/1980 | Sloan | 361/154 |
| 4,443,719 | A * | 4/1984 | Planer et al. | 327/421 |
| 4,992,672 | A * | 2/1991 | Norton | 307/10.1 |
| 4,998,177 | A | 3/1991 | Takizawa et al. | |
| 5,343,351 | A | 8/1994 | Quantz | |
| 5,933,312 | A * | 8/1999 | Schuhbauer et al. | 361/152 |
| 6,229,383 | B1 * | 5/2001 | Ooishi | 327/540 |
| 7,123,458 | B2 * | 10/2006 | Mohr et al. | 361/33 |
| 7,443,648 | B2 * | 10/2008 | Cutter et al. | 361/139 |
| 2005/0275988 | A1 | 12/2005 | Hunninghaus et al. | |

FOREIGN PATENT DOCUMENTS

CN 101090047 A 12/2007

OTHER PUBLICATIONS

Extended European Search Report for European Patent Appln. No. 11180002.5 (Jan. 18, 2012).

* cited by examiner

*Primary Examiner* — Zeev V Kitov

(57) ABSTRACT

A system and method for driving a relay circuit involves driving a relay circuit using a first driver circuit if a voltage of a battery supply for the relay circuit is lower than a voltage threshold and driving the relay circuit using a second driver circuit if the voltage of the battery supply for the relay circuit is higher than the voltage threshold.

5 Claims, 4 Drawing Sheets

SYSTEM AND METHOD FOR DRIVING A RELAY CIRCUIT

Embodiments of the invention relate generally to electrical systems and methods and, more particularly, to systems and methods for driving a relay circuit.

A relay circuit provides electrical isolation between different circuits. Using a relay circuit, a low current circuit can be used to control a high current circuit while the low current circuit is electrically isolated from the high current circuit by the relay circuit. A relay driver circuit is usually used to drive a relay circuit. However, characteristics of the relay circuit such as turn-off speed and lifetime can be affected by the relay driver circuit.

A system and method for driving a relay circuit involves driving a relay circuit using a first driver circuit if a voltage of a battery supply for the relay circuit is lower than a voltage threshold and driving the relay circuit using a second driver circuit if the voltage of the battery supply for the relay circuit is higher than the voltage threshold.

In an embodiment, a method for driving a relay circuit involves driving a relay circuit using a first driver circuit if a voltage of a battery supply for the relay circuit is lower than a voltage threshold and driving the relay circuit using a second driver circuit if the voltage of the battery supply for the relay circuit is higher than the voltage threshold.

In an embodiment, a driver circuit system for driving a relay circuit includes a first driver circuit configured to drive a relay circuit using a first driving mechanism, a second driver circuit configured to drive the relay circuit using a second driving mechanism, and a switch circuit configured to switch off the first driver circuit and to switch on the second driver circuit if a voltage of a battery supply for the relay circuit is higher than a voltage threshold. The second driving mechanism is different from the first driving mechanism.

In an embodiment, a driver circuit system for driving a relay circuit includes a first switch connected to a relay circuit, a second switch connected to a battery supply for the relay circuit, a voltage source, a comparator, a first diode, a second diode, a third diode, and a driver transistor. The comparator includes a first input terminal connected to the battery supply for the relay circuit, a second input terminal connected to the voltage source, and an output terminal connected to the first switch and the second switch. The cathode of the first diode is connected to the first switch, the anode of the first diode is connected to the anode of the second diode, and the cathode of the third diode is connected to the second switch. The cathode of the second diode is connected to the gate of the driver transistor and the anode of the third diode is connected to the driver transistor.

Other aspects and advantages of embodiments of the present invention will become apparent from the following detailed description, taken in conjunction with the accompanying drawings, depicted by way of example of the principles of the invention.

Throughout the description, similar reference numbers may be used to identify similar elements.

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
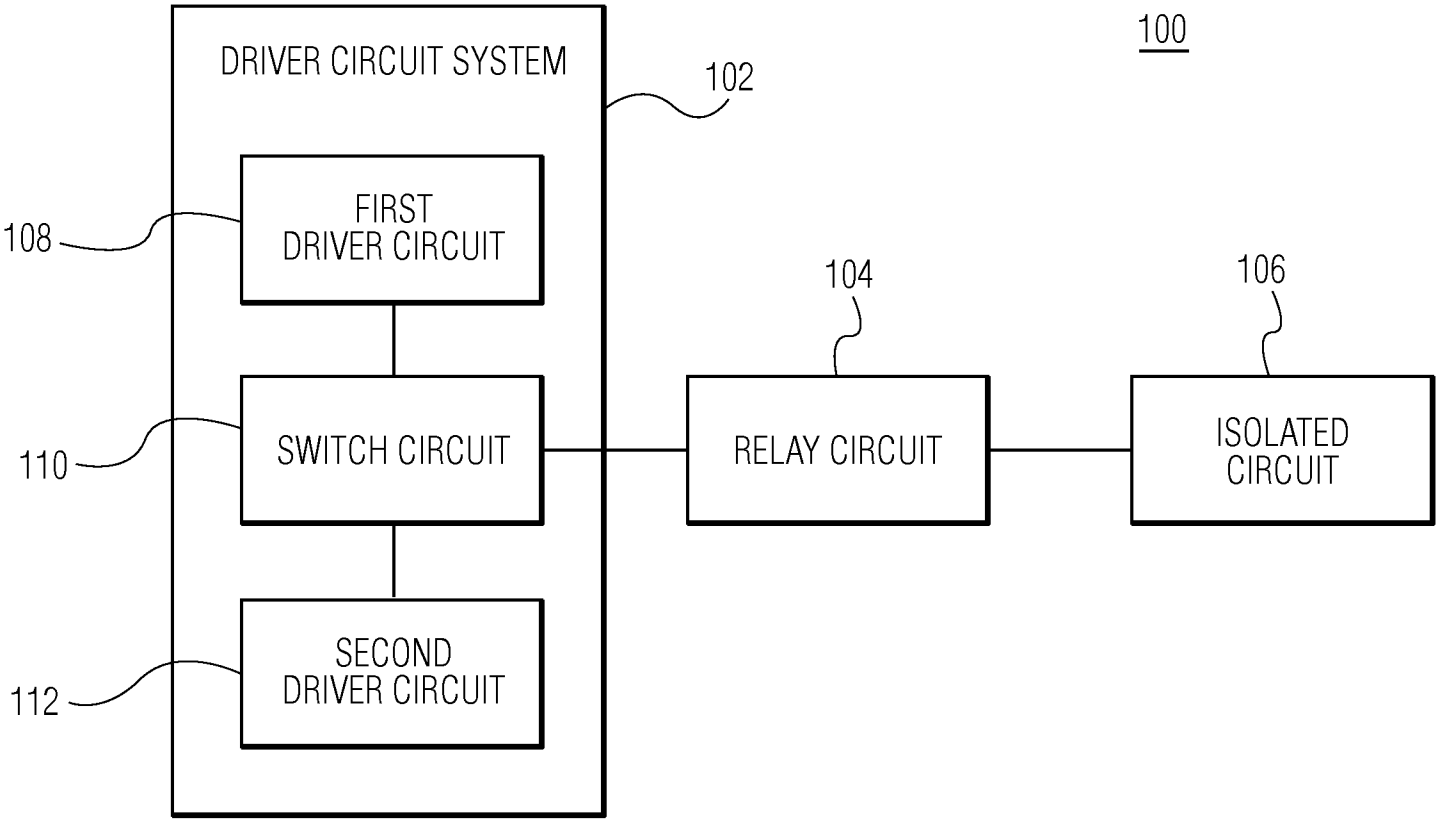
FIG. 1 is a schematic block diagram of an electrical circuit in accordance with an embodiment of the invention.

FIG. 1 is a schematic block diagram of an electrical circuit 100 in accordance with an embodiment of the invention. The electrical circuit may be used for various applications in which an isolated circuit is controlled by another circuit. In some embodiments, the electrical circuit is used for automobile applications such as controlling modules such as engine, rain wipers, window, roof, doors, and/or brakes of a motor vehicle.

In the embodiment depicted in FIG. 1, the electrical circuit 100 includes a driver circuit system 102, a relay circuit 104, and an isolated circuit 106. Although the electrical circuit is depicted and described with certain components and functionality, other embodiments of the electrical circuit may include fewer or more components to implement less or more functionality.

The driver circuit system 102 of the electrical circuit 100 is configured to drive the relay circuit 104 to control the isolated circuit 106. In the embodiment depicted in FIG. 1, the driver circuit system includes a first driver circuit 108, a second driver circuit 112, and a switch circuit 110. Although the driver circuit system is shown in FIG. 1 as including only two driver circuits, the driver circuit system may include more than two driver circuits in other embodiments.

In the embodiment depicted in FIG. 1, the first driver circuit 108 of the driver circuit system 102 is configured to drive the relay circuit using a first driving mechanism. The second driver circuit 112 of the driver circuit system is configured to drive the relay circuit using a second driving mechanism, which is different from the first driving mechanism.

The first driver circuit 108 may include a transistor that is coupled to a diode of the second driver circuit 112.

The switch circuit 110 of the driver circuit system 102 is configured to switch off one of the first and second driver circuits 108, 112 and to switch on another one of the first and second driver circuits if a certain relationship between a voltage of a battery supply for the relay circuit 104 and a voltage threshold is met. In an embodiment, when a circuit is switched off, at least a part of all components in the circuit is disabled and dysfunctional. In this case, when a circuit is switched on, all components in the circuit are enabled and functional.

In an embodiment, the switch circuit 110 switches off the first driver circuit 108 and switches on the second driver circuit 112 if the voltage of the battery supply for the relay circuit is higher than the voltage threshold. In this case, the relay circuit 104 is driven using the second driver circuit if the voltage of the battery supply for the relay circuit is higher than the voltage threshold. The switch circuit switches off the second driver circuit and switches on the first driver circuit if the voltage of the battery supply for the relay circuit is lower than the voltage threshold. In this case, the relay circuit is driven using the first driver circuit if the voltage of the battery supply for the relay circuit is lower than the voltage threshold.

The relay circuit 104 of the electrical circuit 100 provides electrical isolation between the driver circuit system 102 and the isolated circuit 106. In the embodiment depicted in FIG. 1, the relay circuit is configured to be energized by the driver circuit system to control the isolated circuit.

The isolated circuit 106 of the electrical circuit 100 is isolated from the driver circuit system 102 by the relay circuit 104. The isolated circuit usually differs from the driver circuit system in circuit characteristics. For example, the isolated circuit is a high voltage circuit and the driver circuit system is a low voltage circuit. In another example, the isolated circuit is a high current circuit and the driver circuit system is a low current circuit.

Switching off one of the first and second driver circuits 108, 112 and switching on another one of the first and second driver circuits when a certain relationship between the voltage of the battery supply for the relay circuit 104 and the voltage threshold is met enables driving the relay circuit using a particular driver circuit under the certain relationship between the voltages. Therefore, a driver circuit that achieves a particular benefit or has a specific characteristic when there is a certain relationship between the voltage of the battery supply for the relay circuit and the voltage threshold can be chosen from multiple driver circuits to drive the relay circuit.

In some applications, the relationship between the voltage of the battery supply for the relay circuit 104 and a predefined voltage threshold is fixed. For example, in some automotive applications, the voltage of the battery supply is smaller than the voltage threshold in most of the lifetime of the relay circuit. Therefore, a driver circuit can be selected to achieve a particular benefit or to exhibit a specific characteristic under the fixed relationship. When the relationship between the voltage of the battery supply and the predefined voltage threshold changes, a different driver circuit can be chosen to achieve another particular benefit or to exhibit another specific characteristic.

In an embodiment, one of the first and second driver circuits 108, 112 is an active clamping driver circuit and another one of the first and second driver circuits is a free-wheel diode driver circuit. Two of such embodiments of the electrical circuit 100 of FIG. 1 are depicted in FIGS. 2 and 3.

Figure 2:
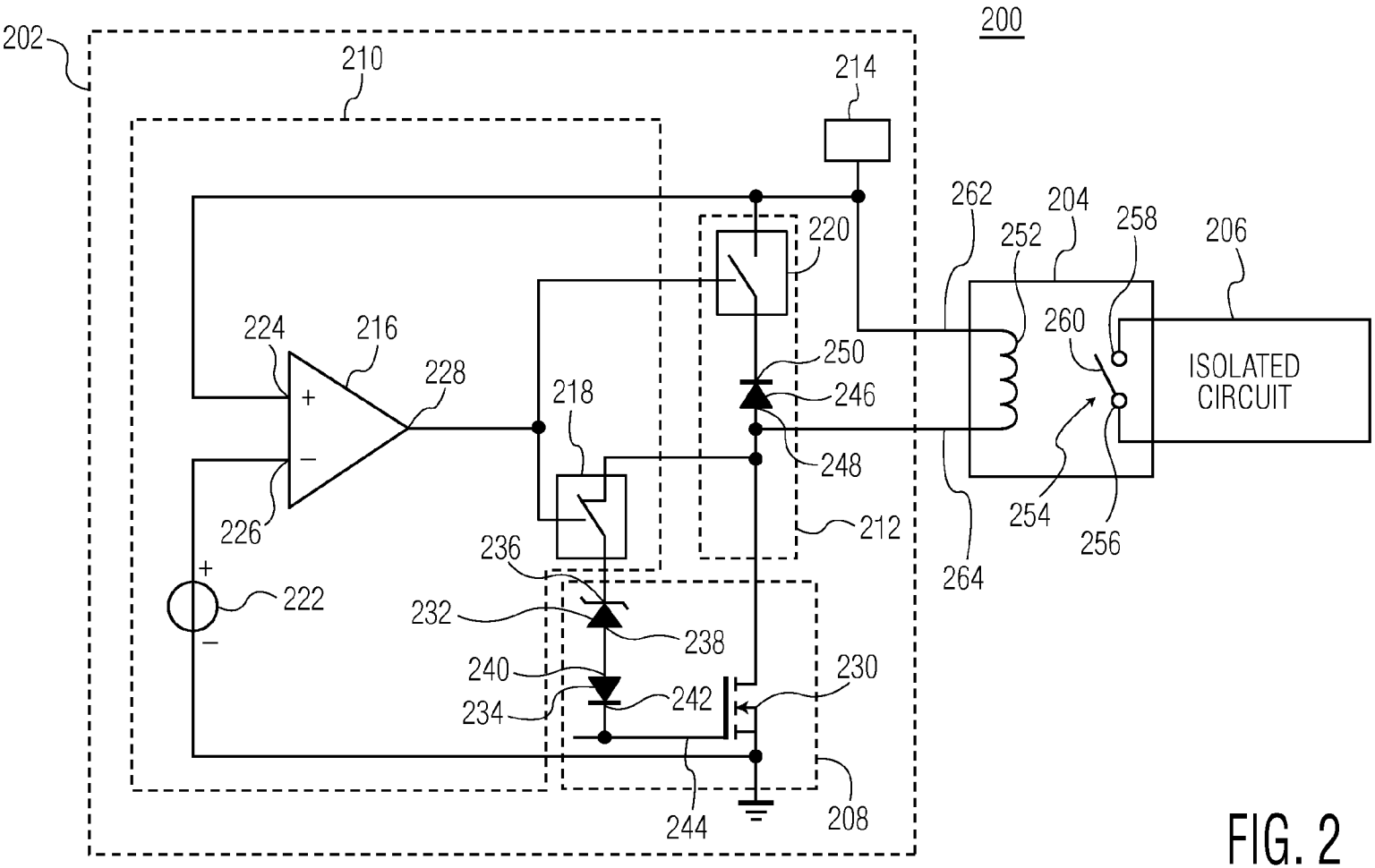
FIG. 2 depicts an embodiment of the electrical circuit of FIG. 1.
Figure 3:
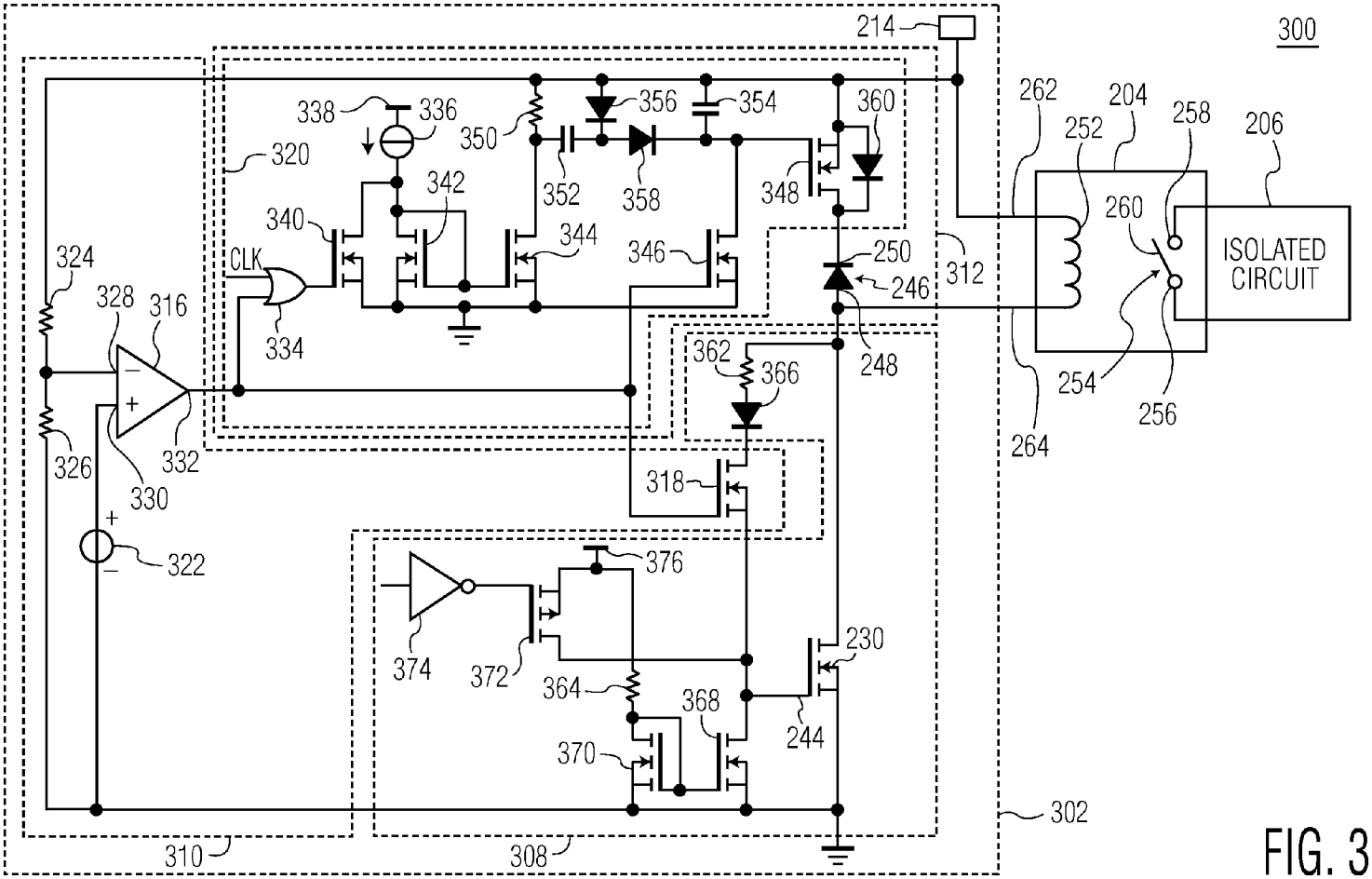
FIG. 3 depicts another embodiment of the electrical circuit of FIG. 1.

The electrical circuits 200, 300 in the embodiments depicted in FIGS. 2 and 3 can be used in automotive applications where the battery supply for the relay circuit is a 12 volt battery supply. The electrical circuits may be used for central body control modules, rain wipers, window lifters, roof modules, power sliding doors, anti-lock braking system (ABS), Electronic stability Programme (ESP), and engine control of a motor vehicle. For example, when the ignition switch of a motor vehicle is turned on, approximately 12 volts is applied to the starter solenoid of the motor vehicle, the coil of the starter solenoid is energized, and the battery voltage is delivered through switch contacts to the starter motor of the motor vehicle.

FIG. 2 depicts an embodiment of the electrical circuit 100 of FIG. 1 in which one of the first and second driver circuits 108, 112 is an active clamping driver circuit and another one of the first and second driver circuits is a free-wheel diode driver circuit. In the embodiment depicted in FIG. 2, the electrical circuit 200 includes a driver circuit system 202, a relay circuit 204, and an isolated circuit 206. The driver circuit system includes a switch circuit 210, an active clamping driver circuit 208, a free-wheel diode driver circuit 212, and a battery supply 214 for the relay circuit 204. Although the driver circuit system is shown in FIG. 2 as including the battery supply for the relay circuit, in other embodiments, the battery supply for the relay circuit may be external to the driver circuit system and not included in the driver circuit system. For example, the battery supply for the relay circuit in a motor vehicle is the main battery of the motor vehicle.

The switch circuit 210 of the driver circuit system 202 includes a comparator 216, a first switch 218, and a voltage source 222. In the embodiment depicted in FIG. 2, the comparator of the switch circuit includes a first input terminal 224 connected to the battery supply 214 for the relay circuit 204, a second input terminal 226 connected to the voltage source, and an output terminal 228 connected to the first switch. The first switch of the switch circuit is configured to switch on or to switch off the active clamping driver circuit 208 under the control of the comparator. The voltage source of the switch circuit is configured to have a voltage value that is equal to the voltage threshold.

In an embodiment, the battery supply 214 for the relay circuit 204 is an automotive 12 volt battery supply and the operating range of the battery supply for the relay circuit is from 5 volts to 18 volts. In this case, the voltage threshold of the voltage source 222 is set to 18 volts. However, in some situations, the voltage value of the battery supply for the relay circuit can rise to be above the voltage threshold of the voltage source. For example, during a vehicle jump start, the voltage value of the battery supply can rise to between 18 volts and 28 volts. During a vehicle load dump, the maximum voltage value of the battery supply can be higher than 28 volts.

The active clamping driver circuit 208 of the driver circuit system 202 includes a driver transistor 230, a first diode 232, and a second diode 234. The active clamping driver circuit limits the output voltage across the driver transistor to a safe value. The driver transistor can be any type of semiconductor transistor. In the embodiment depicted in FIG. 2, the driver transistor is a Metal Oxide Semiconductor Field Effect Transistor (MOSFET). In the embodiment depicted in FIG. 2, the first diode 232 is a Zener diode and the second diode 234 is a normal diode. As depicted in FIG. 2, the cathode 236 of the first diode 232 is connected to the first switch 218, the anode 238 of the first diode 232 is connected to the anode 240 of the second diode 234, and the cathode 242 of the second diode 234 is connected to the gate 244 of the driver transistor. In the embodiment depicted in FIG. 2, the driver transistor is connected to ground.

In the embodiment depicted in FIG. 2, the free-wheel diode driver circuit includes a second switch 220 and a third diode 246. As depicted in FIG. 2, the anode 248 of the third diode 246 is connected to the driver transistor and the cathode 250 of the third diode 246 is connected to the second switch 220. In this configuration, the third diode 246 is connected in parallel with the relay circuit 204 to limit the voltage across the driver transistor and to prevent breakdown of the driver transistor.

Compared to the free-wheel diode driver circuit 212, the active clamping driver circuit 208 significantly increases the turn-off speed of the relay circuit 204 at low supply voltages. Because the lifetime of relay switch contacts in the relay circuit can be determined by the duration of the arc between the relay switch contacts during the turn-off of the relay circuit, the fast turn-off of the relay circuit can increase the lifetime of the relay switch contacts. In addition, compared to the free-wheel diode driver circuit, the active clamping driver circuit increases the dissipation in the driver transistor 230 during the turn-off of the relay circuit. At high supply voltages, the turn-off speed advantage of the active clamping driver circuit disappears and the increase of the dissipation in the driver transistor can be significant enough to threaten the function of the driver transistor. To accommodate the active clamping driver circuit under high supply voltages, the chip area for the driver transistor has to be significantly increased to distribute the increased dissipation in the driver transistor. Furthermore, for the active clamping driver circuit, the clamping voltage should always be higher than the voltage of the battery supply 214 to guarantee to be able to turn off the relay circuit during a load dump.

Compared to the active clamping driver circuit 208, the cost to manufacture the free-wheel diode driver circuit 212 is lower. In addition, the free-wheel diode driver circuit incurs a lower dissipation in the driver transistor 230 during the turn-off of the relay circuit 204. The disadvantage of the free-wheel diode driver circuit is the slow turn-off of the relay circuit under low supply voltages.

Therefore, using only the active clamping driver circuit 208 when the voltage of the battery supply 214 for the relay circuit 204 is lower than a predefined voltage threshold and using only the free-wheel diode driver circuit 212 when the battery supply voltage is higher than a predefined voltage threshold combines the benefit of fast turn-off of the relay circuit with the benefit of the low dissipation of the driver transistor 230. Specifically, by using only the active clamping driver circuit when the battery supply voltage is lower than a predefined voltage threshold, the turn-off speed of the relay circuit at low supply voltages is increased, which in turn increases the lifetime of the relay contacts. In addition, using only the free-wheel diode driver circuit when the battery supply voltage is higher than a predefined voltage threshold has the benefit of low dissipation of the driver transistor while maintaining the same turn-off speed of the relay circuit compared to active clamping. As a result, the dissipation in the driver transistor at high supply voltages can be reduced, which results in a significant reduction in chip area for the driver transistor.

A possible drawback to using only the free-wheel diode driver circuit 212 when the voltage of the battery supply 214 for the relay circuit 204 is higher than a predefined voltage threshold is that the turn-off speed of the relay circuit is low. However, in some applications, the battery supply voltage is smaller than a predefined voltage threshold throughout most of the lifetime of the relay circuit. For example, for automotive applications where the battery supply is an automotive 12 volt battery supply, the battery supply voltage is smaller than the voltage threshold of 18 volts in most of the lifetime of the relay circuit. Typically, a vehicle jump start event, where the battery supply voltage can rise to between 18 volts and 28 volts, occurs only for 600 seconds over a 10 year lifetime. A vehicle load dump event, where the maximum battery supply voltage can be even higher than 28 volts, occurs only for 60 seconds over a 10 year lifetime.

The relay circuit 204 of the electrical circuit 200 provides electrical isolation between the driver circuit system 202 and the isolated circuit 206. In the embodiment depicted in FIG. 2, the relay circuit includes a relay coil 252 and a relay switch 254. The relay switch is connected to the isolated circuit and includes two relay switch contacts 256, 258 and a contact arm 260. The relay switch can be any type of relay switch. In an embodiment, the relay switch is a mechanical relay switch that includes mechanical switch contacts and a mechanical contact arm. The relay coil of the relay circuit is configured to be energized by the driver circuit system to control the relay switch contacts. Specifically, when an electric current from the driver circuit system is passed through the relay coil, the resulting magnetic field connects the relay contacts with the contact arm and enables or closes the relay switch. In the embodiment depicted in FIG. 2, the battery supply 214 for the relay circuit is connected to one terminal 262 of the relay coil and to the second switch 220 while another terminal 264 of the relay coil is connected to the anode 248 of the third diode 246, to the driver transistor 230, and to the first switch 218. The isolated circuit 206 in the embodiment depicted in FIG. 2 is the same as or similar to the isolated circuit 106 in the embodiment depicted in FIG. 1.

FIG. 3 depicts another embodiment of the electrical circuit 100 of FIG. 1 in which one of the first and second driver circuits 108, 112 is an active clamping driver circuit and another one of the first and second driver circuits is a free-wheel diode driver circuit. In the embodiment depicted in FIG. 3, the electrical circuit 300 includes a driver circuit system 302, a relay circuit 204, and an isolated circuit 206.

The driver circuit system 302 of the electrical circuit 300 includes a switch circuit 310, an active clamping driver circuit 308, a free-wheel diode driver circuit 312, and a battery supply 214 for the relay circuit 204. Although the driver circuit system is shown in FIG. 3 as including the battery supply for the relay circuit, in other embodiments, the battery supply for the relay circuit may be external to the driver circuit system and not included in the driver circuit system.

In the embodiment depicted in FIG. 3, the switch circuit 310 of the driver circuit system 302 includes a comparator 316, a switch transistor 318 for the active clamping driver circuit 308, a voltage source 322, a resistor 324 connected between the comparator and the battery supply 214 for the relay circuit 204, and a resistor 326 connected between the comparator and the voltage source.

The comparator 316 of the switch circuit 310 includes a first input terminal 328 connected to the battery supply 214 for the relay circuit 204 via the resistor 324, a second input terminal 330 connected to the voltage source 322, and an output terminal 332 connected to the switch transistor 318.

The switch transistor 318 of the switch circuit 310 is configured to switch on or to switch off the active clamping driver circuit 308 under the control of the comparator 316. The voltage source 322 of the switch circuit is configured to have a voltage value that is equal to a bandgap voltage.

The active clamping driver circuit 308 of the driver circuit system 302 includes a driver transistor 230, resistors 362, 364, a diode 366, transistors 368, 370, 372, and a NOT gate 374. The active clamping driver circuit is switched on or off by the switch transistor 318 under the control of the comparator 316 to limit the output voltage across the driver transistor to a safe value. In the embodiment depicted in FIG. 3, the driver transistor is driven by input signals to the NOT gate and the switch transistor 318 enables the active clamp driver circuit when the driver transistor 230 is driven high. The gate 244 of the driver transistor 230 is connected to the switch transistor 318 and the transistors 368 and 372. The transistor 372 is connected to a fixed voltage source 376, such as 3.3 volts. In the embodiment depicted in FIG. 3, the transistors 230, 368, and 370 are connected to ground.

The free-wheel diode driver circuit includes a switch transistor circuit 320 and a diode 246. In the embodiment depicted in FIG. 3, the switch transistor circuit 320 includes an OR gate 334, a current source 336 connected to a fixed voltage source 338, such as 3.3 volts, transistors 340, 342, 344, 346, 348, a resistor 350, capacitors 352, 354, and diodes 356, 358. The OR gate of the switch transistor circuit includes an input terminal configured to receive a clock signal (CLK) and another input terminal connected to the output terminal 332 of the comparator 316. The transistors 340, 342, and 344 are connected between the current source and ground. The resistor 350, the capacitor 354, the transistor 348, and the diodes 356 and 360 are connected to the battery supply 214. In the embodiment depicted in FIG. 3, the transistor 348 includes an internal back-gate diode 360. In the embodiment depicted in FIG. 3, the anode 248 of the diode 246 is connected to the driver transistor and the cathode 250 of the diode 246 is connected to the switch transistor circuit 320. In this configuration, the diode 246 is connected in parallel with the relay circuit 204 to limit the voltage across the driver transistor to prevent breakdown of the driver transistor.

Two examples of operations of the electrical circuit 300 are described below. In the first example, the battery supply 214 to the relay circuit 204 and to the resistors 324 and 326 satisfies:

$$V_{bat} < \frac{V_{thre} \times (R_1 + R_2)}{R_1}, \quad (1)$$

where $V_{bat}$ represents the voltage of the battery supply, $V_{thre}$ represents the voltage threshold of the voltage source 322, $R_1$ represents the resistance value of the resistor 326, and $R_2$ represents the resistance value of the resistor 324. In this case, the comparator output at the output terminal 332 is logic high and the active clamping driver circuit 308 is activated by the switch transistor 318. When the input signal at the NOT gate 374 is logic '1', the gate of the transistor 372 is driven to ground and the gate 244 of the driver transistor 230 is driven with the fixed voltage source 376. The terminal 264 of the relay circuit 204 is driven low and the relay circuit is activated. When the input signal at the NOT gate 374 becomes logic '0', the transistor 372 opens and the gate voltage of the driver transistor 230 starts to drop. The electric current through the driver transistor 230 and the relay coil 252 of the relay circuit decreases while the inductance of the relay coil generates a high voltage on the terminal 264 of the relay circuit. If the voltage on the terminal 264 of the relay circuit becomes higher than a voltage value, the gate 244 of the driver transistor 230 will be driven by the voltage feedback via the resistor 362, the diode 366, and the switch transistor 318, which effectively clamps the voltage on the terminal 264 of the relay circuit and decreases the current through the driver transistor 230 to zero. When the current stops flowing through the driver transistor 230, the voltage on the terminal 264 of the relay circuit will drop back to the battery supply level and the gate of the driver transistor 230 will be pulled down to ground.

In the second example, the battery supply 214 to the relay circuit 204 and to the resistors 324 and 326 satisfies:

$$V_{bat} > \frac{V_{thre} \times (R_1 + R_2)}{R_1}, \quad (2)$$

where $V_{bat}$ represents the voltage of the battery supply, $V_{thre}$ represents the voltage threshold of the voltage source 322, $R_1$ represents the resistance value of the resistor 326, and $R_2$ represents the resistance value of the resistor 324. The comparator output at the output terminal 332 is logic low and the active clamping driver circuit 308 is disabled. When the input signal at the NOT gate 374 makes the transition from logic '1' to logic '0', the current through the driver transistor 230 will immediately become zero, which results in a positive peak voltage on the terminal 264 of the relay circuit 204 caused by the inductance of the relay coil 252. Because the comparator output at the output terminal 332 is logic low, transistors 340 and 346 are now open and the charge pump circuit builds around transistors 342, 344, the resistor 350, the capacitors 352, 354, and the diodes 356 and 358 drives the transistor 348. The current of the relay coil 252 now runs through the diode 246 of the free-wheel diode driver circuit 312 to discharge the inductance.

Figure 4:
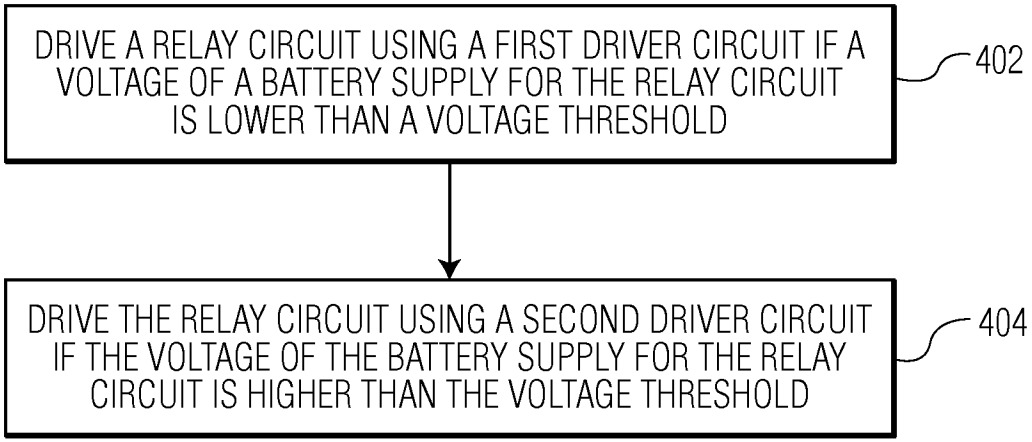
FIG. 4 is a process flow diagram of a method for driving a relay circuit in accordance with an embodiment of the invention.

FIG. 4 is a process flow diagram of a method for driving a relay circuit in accordance with an embodiment of the invention. At block 402, a relay circuit is driven using a first driver circuit if a voltage of a battery supply for the relay circuit is lower than a voltage threshold. At block 404, the relay circuit is driven using a second driver circuit if the voltage of the battery supply for the relay circuit is higher than the voltage threshold.

Although the operations of the method herein are shown and described in a particular order, the order of the operations of the method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

In addition, although specific embodiments of the invention that have been described or depicted include several components described or depicted herein, other embodiments of the invention may include fewer or more components to implement less or more feature.

Furthermore, although specific embodiments of the invention have been described and depicted, the invention is not to be limited to the specific forms or arrangements of parts so described and depicted. The scope of the invention is to be defined by the claims appended hereto and their equivalents.

What is claimed is:

1. A driver circuit system for driving a relay circuit, the driver circuit system comprising:

a first switch connected to a relay circuit;

a second switch connected to a battery supply for the relay circuit;

a voltage source that is other than the battery supply;

a comparator, wherein the comparator comprises:

a first input terminal connected to the battery supply for the relay circuit;

a second input terminal connected to the voltage source; and an output terminal connected to the first switch and the second switch, a first diode, wherein the cathode of the first diode is connected to the first switch;

a second diode, wherein the anode of the first diode is connected to the anode of the second diode;

a third diode, wherein the cathode of the third diode is connected to the second switch;

a driver transistor, wherein the cathode of the second diode is connected to the gate of the driver transistor and the anode of the third diode is connected to the driver transistor, wherein the relay circuit comprises a relay coil, wherein the battery supply for the relay circuit is connected to one terminal of the relay coil and the second switch, and wherein another terminal of the relay coil is connected to the anode of the third diode, the driver transistor, and the first switch.

2. The driver circuit system of claim 1, wherein the comparator is configured to switch off the first switch and to switch on the second switch if a voltage of the battery supply for the relay circuit is higher than a voltage of the voltage source.

3. The driver circuit system of claim 2, wherein only the driver transistor and the third diode drive the relay circuit after the first switch is switched off and the second switch is switched on.

4. The driver circuit system of claim 2, wherein only the driver transistor, the first diode, and the second diode drive the relay circuit before the first switch is switched off and the second switch is switched on.

5. The driver circuit system of claim 1, wherein the battery supply is an automotive 12 volt battery supply, and wherein the voltage threshold is 18 volts.

* * * * *